US005674374A

United States Patent [19]

Sakurai et al.

[11] Patent Number: 5,674,374

[45] Date of Patent: Oct. 7, 1997

[54] SN-BI ALLOY-PLATING BATH AND PLATING METHOD USING THE SAME

[75] Inventors: Hitoshi Sakurai, Matsudo; Satoshi Yuasa, Funabashi, both of Japan

[73] Assignee: Dipsol Chemicals Co., Ltd., Tokyo, Japan

[21] Appl. No.: 348,119

[22] Filed: Nov. 28, 1994

[51] Int. Cl.[6] ..... C25D 3/32

[52] U.S. Cl. ..... 205/252; 205/253; 106/1.25

[58] Field of Search ..... 205/252, 253; 106/1.25

[56] References Cited

U.S. PATENT DOCUMENTS

| | | | |
|---|---|---|---|
| 3,616,291 | 10/1971 | Wilson | 205/153 |
| 4,162,205 | 7/1979 | Wilson et al. | 205/253 |
| 4,163,700 | 8/1979 | Igarashi et al. | 205/253 |

FOREIGN PATENT DOCUMENTS

| | | | |
|---|---|---|---|
| 2 406 676 | 5/1979 | France . | |
| 5034 | 1/1978 | Japan | 205/253 |
| 63-14887 | 1/1988 | Japan . | |
| 2-88789 | 3/1990 | Japan . | |
| 88789 | 3/1990 | Japan . | |
| 463747 | 3/1975 | U.S.S.R. | 205/253 |
| 763486 | 9/1980 | U.S.S.R. | 205/253 |

OTHER PUBLICATIONS

Protection of Metals, vol. 25, No. 4, Jul./Aug. 1989, pp. 532–533, G.A. Kurnoskin, et al., "A Citrate Electrolyte for Deposition of Tin–bismuth Coatings".

Surface Treatment Technology Abstacts, vol. 28, No. 2, Mar./Apr. 1986, p. 72, I.N. Sorokin, et al., "Electrodeposition of Sn–Bi Alloy".

Database WPI, Derwent Publications, Week 9302, Mar. 3, 1993, AN–93–016064/02, SU–1712469, Oct. 31, 1989.

*Primary Examiner*—Kathryn L. Gorgos
*Assistant Examiner*—Kishor Mayekar
*Attorney, Agent, or Firm*—Oblon, Spivak, McClelland, Maier & Neustadt, P.C.

[57] ABSTRACT

A Sn—Bi alloy plating bath comprises at least one compound selected from the group consisting of polyoxy monocarboxylic acids, polyoxy lactones, polycarboxylic acids and salts thereof. A plating method comprises the step of applying a Sn—Bi alloy plating film to a substrate in the foregoing plating bath. The plating bath permits the formation of a Sn—Bi alloy plating film having a bismuth content ranging from 0.1 to 75% over a wide current density range. Moreover, the plating bath never forms precipitates, does not become turbid, does not cause any change of the bath composition and is, therefore, quite stable even when it is stored over a long period of time.

22 Claims, No Drawings

SN-BI ALLOY-PLATING BATH AND PLATING METHOD USING THE SAME

BACKGROUND OF THE INVENTION

The present invention relates to a Sn—Bi alloy-plating bath and a plating method which makes use of the plating bath. More specifically, the present invention relates to a Sn—Bi alloy-plating bath and a plating method capable of forming a Sn—Bi alloy plating film, on a subject to be plated, which does not have adverse effects such as erosion, deformation and deterioration on the subject.

Tin plating and solder plating have widely been used in the fields of weak electric and electronic industries for the improvement of soldering properties of various parts or as etching resists. However, the tin plating suffers from a problem of whiskering, while the problem of water pollution with lead has been highlighted recently with regard to the solder plating.

As a novel and promising plating method which does not suffer from such problems, a Sn—Bi alloy plating has attracted special interest recently. The Sn—Bi alloy plating has long become a center of attraction as a low melting point plating and these techniques generally relate to the formation of a plating film having a bismuth content ranging from 30 to 50% by weight (hereunder referred to as simply "%"). However, the Sn—Bi alloy-plating bath is generally strongly acidic since it is needed to dissolve a large amount of bismuth therein. For instance, Japanese Un-examined Patent Publication (hereunder referred to as "J. P. KOKAI") No. Sho 63-14887 discloses a Sn—Bi alloy-plating bath as a kind of Bi alloy-plating bath, which is strongly acidified by addition of an organic sulfonic acid in order to ensure dissolution of a bismuth salt. Moreover, J.P. KOKAI No. Hei 2-88789 discloses a Bi alloy-plating bath which is strongly acidified through addition of an inorganic acid or an organic sulfonic acid. The inventors of this invention determined the pH values of these plating baths and found that they had a pH value of not more than 0.5.

However, most of parts as subjects, to which the tin plating and solder plating are applied, are composed of composite materials of metals and insulating substances such as ceramics, lead glass, plastics and ferrite which are quite susceptible to the plating of this kind and may undergo, for instance, erosion, deformation and deterioration. For this reason, there has been desired for the development of a Sn—Bi alloy plating bath which is not strongly acidic.

SUMMARY OF THE INVENTION

Accordingly, an object of the present invention is to provide a Sn—Bi alloy-plating bath having excellent storage stability and capable of forming a Sn—Bi alloy plating film which does not have adverse effects such as erosion, deformation and deterioration on a subject to be plated.

Another object of the present invention is to provide a plating method which allows the application of a Sn—Bi alloy plating film to the surface of a substrate at high efficiency.

These and other objects of the present invention will be apparent from the following description and Examples.

The present inventors have conducted intensive studies to solve the foregoing problems associated with the conventional techniques, and as a result, the inventors have found that the use of a polyoxy monocarboxylic acid, a polyoxy lactone, a polycarboxylic acid or a salt thereof permits the fomation of a Sn—Bi alloy-plating bath having a bismuth content ranging from 0.1 to 75% even within the neutral pH range, that the use of such a plating bath allows the plating of subjects comprising, for instance, ceramics, lead glass, plastics and/or ferrite without exerting, upon the subjects, any bad influence such as erosion, deformation and deterioration and that these compounds can provide a highly stable plating bath which does not form, for instance, precipitates even when the bath is allowed to stand over a long period of time, and thus have completed the present invention on the basis of these findings.

According to the present invention, the foregoing object can effectively be accomplished by providing a Sn—Bi alloy-plating bath which comprises at least one compound selected from the group consisting of polyoxy monocarboxylic acids, polyoxy lactones, polycarboxylic acids and salts thereof.

According to another aspect of the present invention, there is provided a plating method which comprises the step of applying a Sn—Bi plating film onto the surface of a substrate using the aforementioned Sn—Bi alloy-plating bath.

DESCRIPTION OF THE PREFERRED EMBODIMENTS

The present invention will be described in more detail below.

The polyoxy monocarboxylic acid used in the present invention may be, for instance, a compound having at least two, preferably 2 to 6 hydroxyl groups and a carboxyl group in the molecule, with those having 3 to 7 carbon atoms being preferably used. Specific examples thereof include glyceric acid, gluconic acid and glucoheptonic acid.

The polyoxy lactone used in the present invention may be, for instance, lactones having at least two, preferably 2 to 5 hydroxyl groups in the molecule, with lactone compounds having 3 to 7 carbon atoms being preferred. Specific examples thereof include gluconolactone and glucoheptonolactone.

The polycarboxylic acid used in the present invention may have at least two, preferably 2 to 5 carboxyl groups in the molecule, with those having 3 to 7 carbon atoms being preferably used. In this connection, aminopolycarboxylic acids can be used as one of the polycarboxylic acids. Preferred are aminopolycarboxylic acids having to carbon atoms, more preferably 2 to 5 carboxyl groups and 1 to 4 amino groups. Specific examples of the polycarboxylic acids usable in the present invention include malonic acid, maleic acid, succinic acid, tricarballylic acid, citric acid, tartaric acid, maleic acid, 2-sulfoethylimino-N,N-diacetic acid, iminodiacetic acid, nitrilotriacetic acid, EDTA, triethylenediamine-tetaacetic acid, glutamic acid, aspartic acid and β-alanine-N,N-diacetic acid. Among these, preferred are malonic acid, citric acid, malic acid, EDTA and glutamic acid.

In addition, examples of salts of these polyoxy monocarboxylic acids, polyoxy lactones and polycarboxylic acids include alkali metal salts such as sodium, potassium and lithium salts; alkaline earth metal salts such as magnesium, calcium and barium salts; salts of divalent tin; bismuth salts; ammonium salts; and organic amine salts such as monomethylamine, dimethylamine, trimethylamine, ethylamine, isopropylamine, ethylenediamine and diethylenetriamine salts. Among these, preferred are sodium, potassium, ammonium, divalent tin and bismuth salts.

These polyoxy monocarboxylic acids, polyoxy lactones, polycarboxylic acids and their salts may be used alone or in combination.

The Sn—Bi alloy-plating bath may comprise the polyoxy monocarboxylic acid, polyoxy lactone, polycarboxylic acid and/or salt thereof in any concentration, but the concentration thereof preferably ranges from 0.2 to 2.0 mole/l, in particular, 0.25 to 1.0 mole/l.

The concentration of tin ions in the plating bath of the invention is preferably adjusted such that the concentration of divalent tin ions preferably ranges from 1 to 50 g/l and more preferably 5 to 40 g/l In addition, the concentration of bismuth ions in the plating bath is preferably adjusted such that the concentration of trivalent bismuth ions ranges from 0.2 to 40g/l and more preferably 1 to 30 g/l These metal ion concentrations are controlled by adding, to water, a tin compound and a bismuth compound capable of being dissociated into these ions in an aqueous solution.

The compounds of divalent tin and trivalent bismuth usable in the present invention include, for instance, hydroxides, oxides, sulfates, hydrochlorides, sulfamic acid salts, pyrophosphoric acid salts, carboxylic acid salts, amino acid salts and sulfonates of these metals, with oxides, sulfates and hydrochlorides thereof being preferred. Specific examples of the carboxylic acid salts include salts of monocarboxylic acids such as formic acid, acetic acid and propionic acid; and oxycarboxylic acids such as lactic acid and glycolic acid, in addition to the aforementioned salts of polyoxy monocarboxylic acids, polyoxy lactones and polycarboxylic acids. Specific examples of the amino acids salts are those of asparagine, histidine, leucine, serine, valine, tyrosine, tryptophane, proline, glycine, and alanine. Examples of the sulfonates include salts of alkanesulfonic acids, alkanolsulfonic acids and phenolsulfonic acids. Specific examples of the alkanesulfonic acids include methanesulfonic acid, ethanesulfonic acid, propanesulfonic acid, isopropanesulfonic acid, butanesulfonic acid, pentanesulfonic acid and hexanesulfonic acid; specific examples of the alkanolsulfonic acids are 2-hydroxyethanesulfonic acid, 3-hydroxypropanesulfonic acid and 2-hydroxybutanesulfonic acid. In addition, specific examples of the phenolsulfonic acids include phenolsulfonic acid, cresolsulfonic acid and dimethylphenolsulfonic acid.

The plating bath of the present invention may further comprise, for the improvement of the conductivity thereof during plating, alkali metal salts (such as sodium, potassium and lithium salts), alkaline earth metal salts (such as magnesium, calcium and barium salts), ammonium salts, organic amine salts (such as monomethylamine, dimethylamine, trimethylamine, ethylamine, isopropylamine, ethylenediamine and diethylenetriamine salts) of, for instance, sulfuric acid, hydrochloric acid, sulfamic acid, pyrophosphoric acid and sulfonic acid. Specific examples thereof include ammonium sulfate, ammonium chloride, sodium pyrophosphate, monomethylamine sulfamate, with ammonium sulfate and ammonium chloride being particularly preferred. The content of these salts in the plating bath ranges from 10 to 200 g/l and preferably 50 to 150 g/l.

The plating bath of the present invention may further comprise, in addition to the foregoing components, brightening agents and/or smoothing agents. Examples of such brightening agents include nonionic surfactants such as alkyl nonylphenyl ethers; and water-soluble brightening agents prepared by reacting phthalic anhydride with reaction products of aliphatic amines and organic acid esters and examples of smoothing agents are peptone and gelatin. If the plating bath comprises these brightening and/or smoothing agents, the foregoing surfactant is used in an amount ranging from 0.1 to 20 g/l, preferably 4 to 8 g/l; the water-soluble brightening agent prepared from an aliphatic amine as an ingredient is used in an amount ranging from 0.1 to 20 g/l, preferably 0.2 to 10 g/l; and peptone or gelatin is used in an amount ranging from 0.1 to 20 g/l, preferably 0.2 to 10 g/l. The addition of these brightening agent and/or smoothing agent ensures the formation of a uniform plating film having a fine structure.

The Sn—Bi plating bath of the present invention comprising the foregoing components preferably has a pH value ranging from 2 to 9 and more preferably 4 to 8. This is because if the pH thereof is less than 2, the acidity thereof is too high, while if it exceeds 9, the stability of metal ions, in particular, bismuth ions is impaired and the alkalinity thereof adversely affects the subject to be plated and may result in, for instance, the erosion, deformation and/or deterioration of the subject. The pH of the plating bath can be controlled by appropriately adjusting the amounts of the foregoing components used within the ranges defined above. Alternatively, an alkali or an acid may be used for adjusting the pH of the plating bath so that it falls within the range defined above. In this respect, if bismuth oxide is used as the bismuth compound, it should be previously dissolved in water using a strong acid and then the pH value of the solution is controlled by the addition of an alkali so that it falls within the foregoing range. Examples of such strong acids include sulfuric acid, hydrochloric acid, sulfonic acid and pyrophosphoric acid. Examples of alkaline compounds used for the neutralization or pH-adjustment are sodium hydroxide, potassium hydroxide and aqueous ammonia.

The plating method of the present invention which makes use of the plating bath of the invention discussed above will now be detailed below.

Examples of substrates (subjects to be plated) to which a Sn—Bi alloy plating film is applied using the plating bath of the present invention include metals, for instance, copper and copper alloys such as brass, iron and iron alloys, and nickel and nickel alloys; and composite materials of metals with insulating materials such as ceramics, lead glass, plastics and ferrite. The method of the present invention is particularly effective for plating such composite materials of metals with insulating materials such as ceramics, lead glass, plastics and ferrite. The plating method is performed while using the subject to be plated as a cathode and an anode such as a Sn—Bi alloy, elemental bismuth, elemental tin, optionally a platinum-plated titanium plate or a carbon plate. The bath temperature in general ranges from 10° to 40° C. and preferably 15° to 30° C. The cathode current density can usually be set at the range of from 0.1 to 5 A/dm$^2$. The plating time varies depending on the required thickness of the resulting plating film, but in general ranges from 1 to 120 minutes and preferably 5 to 60 minutes. The bath may be stirred using a mechanical stirring machine such as jet stirring machine or a cathode rocker. The thickness of the plating film may widely vary, but in general ranges from 0.5 to 500 μm and preferably 5 to 20 μm. The bismuth content in the resulting Sn—Bi alloy plating film in general ranges from 0.1 to 75% and preferably 5 to 70%. The pH of the plating bath is preferably controlled to the range of from 2 to 9 throughout the plating operation.

When plating a subject to be plated, the subject is first pretreated by the usual method and then subjected to a plating treatment. The pretreatment comprises at least one step selected from the group consisting of degreasing by immersion, washing with an acid, and electrolytic washing of an anode and activation. Water washing is performed between every successive two steps. After the plating operation, the resulting plating film is subjected to simple washing and then dried. The plating step may be carried out not only in a static bath, but also in a barrel. The plated subject may be subjected to a discoloration-inhibitory treatment (such as immersion in sodium tertiary phosphate aqueous solution) which has commonly been used after the tin plating and solder plating.

The plating liquid of the present invention can be used over a long time period without replacing with fresh one if an appropriate replenisher is added to the bath to hold the concentrations of the bath components constant.

As has been described above in detail, the present invention permits the formation of a Sn—Bi alloy plating film having a bismuth content ranging from 0.1 to 75% over a wide current density range. Moreover, the plating bath of the present invention never forms precipitates, does not become turbid, does not cause any change of the bath composition and is, therefore, quite stable even when it is stored over a long period of time.

The melting point, soldering properties and whiskering properties of the Sn—Bi alloy plating applied to a substrate according to the plating method of the present invention is comparable to those of the presently used Sn—Bi alloy plating (solder plating) and the plating method does not exert adverse effects such as erosion of subjects to be plated comprising, for instance, ceramics, lead glass, plastics and ferrite.

The present invention will hereunder be explained in more detail with reference to the following working Examples, but the present invention is not limited to these specific Examples.

EXAMPLES 1 to 8

A copper plate was degreased with a 5% (w/v) Degrease-39 (available from Dipsol Company) and then washed with a 10.5% (w/w) hydrochloric acid solution. Subsequently, the copper plate was electrolytically washed with a 5% (w/w) NC-20 (available from Dipsol Company) and a 7% (w/v) sodium hydroxide solution. After the electrolytic washing, the plate was activated with a 3.5% hydrochloric acid solution. Water washing of the plate was carried out between every two successive operations.

On the other hand, each plating liquid having a composition shown in the following Table 1 was introduced into a plating tank of acrylic resin and plating operations were carried out while using a platinum plate as an anode and connecting the foregoing activated copper plate to a cathode, under the conditions given in the following Table 2. In this respect, metal compounds used for preparing the plating baths were tin sulfate and bismuth sulfate.

The resulting plating films each was inspected for the film thickness and the alloy composition. The film thickness was determined by a thickness tester (electromagnetic method) and the alloy composition was determined by the fluorescent X-ray analysis.

Then each resulting plating film was inspected for the soldering properties and the whisker formation. The soldering properties was estimated by determining the point (zero cross time) at which the buoyancy due to wetting became zero, using the vertical immersion method which made use of Meniscograph (a solder checker available from Reska Company), while the estimation of whisker formation was carried out by subjecting each plating film applied onto the surface of a brass substrate to an accelerated test which comprised allowing the plating film to stand in a thermostatic chamber maintained at 50° C. for 7 days and observing the plated surface. Moreover, the stability of the plating bath was estimated by allowing each plating liquid to stand at room temperature for one week and then determining the presence of precipitates and turbidity. The results thus obtained are summarized in the following Table 3.

COMPARATIVE EXAMPLES 1 to 5

The same procedures used in Example 1 to 8 were repeated except that plating liquids each having the composition shown in the following Table 4 was used and that the plating operation was performed under the conditions listed in Table 5. The results obtained were summarized in Table 6. Incidentally, the metal compounds used for preparing the plating baths were tin borofluoride and lead borofluoride in Comparative Examples 1 and 2 and tin sulfate and bismuth oxide in Comparative Examples 3 to 4.

TABLE 1

Compositions of Plating Baths

| Component | Example No. | | | | |
|---|---|---|---|---|---|
| (g/l) | 1 | 2 | 3 | 4 | 5 |
| $Sn^{2+}$ | 22.5 | 22.5 | 22.5 | 22.5 | 10 |
| $Bi^{3+}$ | 2.5 | 2.5 | 7.5 | 7.5 | 7.5 |
| Gluconic Acid | 150 | 150 | 0 | 0 | 0 |
| Glucoheptonic Acid | 0 | 0 | 0 | 120 | 120 |
| Gluconolactone | 0 | 0 | 120 | 0 | 0 |
| Ammonium Sulfate | 80 | 80 | 0 | 0 | 0 |
| Sodium Chloride | 0 | 0 | 80 | 0 | 0 |
| Ammonium Methanesulfonate | 0 | 0 | 0 | 80 | 80 |
| Brightener I*1 | 2 | 2 | 0 | 5 | 0 |
| Brightener II*2 | 0 | 0 | 5 | 0 | 0 |
| Peptone | 0 | 0 | 0 | 0 | 1 |
| pH | 8.0 | 8.0 | 3.5 | 4.5 | 6.0 |

| Component | Example No. | | |
|---|---|---|---|
| (g/l) | 6 | 7 | 8 |
| $Sn^{2+}$ | 22.5 | 22.5 | 22.5 |
| $Bi^{3+}$ | 2.5 | 7.5 | 7.5 |
| Citric Acid | 120 | 0 | 0 |
| Glutamic Acid | 0 | 120 | 120 |
| Ammonium Sulfate | 80 | 0 | 0 |
| Sodium Chloride | 0 | 80 | 80 |
| Brightener I*1 | 2 | 0 | 0 |
| Brightener II*2 | 0 | 5 | 5 |
| pH | 8.0 | 3.5 | 3.5 |

*1: A water-soluble brightener obtained by reacting phthalic anhydride with a reaction product of an aliphatic amine and an organic acid ester.
*2: An alkyl nonylphenyl ether to which 15 moles of ethylene oxide are added.

TABLE 2

Plating Conditions

| | Example No. | | | | |
|---|---|---|---|---|---|
| | 1 | 2 | 3 | 4 | 5 |
| Cathode Current Density ($A/dm^2$) | 5.0 | 0.2 | 0.2 | 5.0 | 0.2 |
| Plating Temperature (°C.) | 25 | 25 | 25 | 25 | 25 |
| Plating Time (min) | 4 | 60 | 60 | 4 | 60 |

| | Example No. | | |
|---|---|---|---|
| | 6 | 7 | 8 |
| Cathode Current Density ($A/dm^2$) | 0.2 | 5.0 | 0.2 |
| Plating Temperature (°C.) | 25 | 25 | 25 |
| Plating Time (min) | 60 | 4 | 60 |

TABLE 3

Properties of Plating Film

| Properties | Example No. 1 | 2 | 3 | 4 | 5 |
|---|---|---|---|---|---|
| Appearance of Plating Film*3 | Δ | Δ | X | X | X |
| Thickness of Plating Film (μ) | 5.5 | 5.5 | 5.5 | 5.5 | 5.5 |
| Bi Content (%) | 6.5 | 6.8 | 38.1 | 36.9 | 55.5 |
| Melting Point (°C.) | 200 | 200 | 180 | 180 | 145 |
| Soldering Properties | 1.2 | 1.2 | 0.9 | 0.9 | 0.8 |
| Whisker Formation | None*4 | None*4 | None | None | None |
| Stability of Bath*5 | None | None | None | None | None |

| Properties | Example No. 6 | 7 | 8 |
|---|---|---|---|
| Appearance of Plating Film*3 | Δ | X | X |
| Thickness of Plating Film (μ) | 5.5 | 5.5 | 5.5 |
| Bi Content (%) | 7.1 | 36.8 | 28.0 |
| Melting Point (°C.) | 200 | 180 | 180 |
| Soldering Properties | 1.2 | 0.9 | 0.9 |
| Whisker Formation | None*4 | None | None |
| Stability of Bath*5 | None | None | None |

*3Δ . . . semi-gloss; X . . . lusterless.
*4Wen-like projections were observed.
*5The condition of the bath after allowing to stand for one week (presence or absence of precipitates, turbidity).

TABLE 4

Compositions of Plating Baths (Comparative Examples)

| Component (g/l) | 1 | 2 | 3 | 4 |
|---|---|---|---|---|
| $Sn^{2+}$ | 18 | 18 | 1.8 | 1.8 |
| $Bi^{3+}$ | 0 | 0 | 7.1 | 7.1 |
| $Pb^{2+}$ | 1.5 | 9 | 0 | 0 |
| Sulfuric Acid | 0 | 0 | 100 | 0 |
| Methanesulfonic Acid | 0 | 0 | 0 | 98 |
| Gluconic Acid | 0 | 0 | 50 | 0 |
| Citric Acid | 0 | 0 | 0 | 50 |
| Hydroborofluoric Acid | 180 | 180 | 0 | 0 |
| Boric Acid | 20 | 20 | 0 | 0 |
| Brightener II | 0 | 0 | 5 | 5 |
| Peptone | 1 | 1 | 0 | 0 |
| pH | 1> | 1> | 0.5> | 0.5> |

TABLE 5

Plating Conditions (Comparative Examples)

| | 1 | 2 | 3 | 4 |
|---|---|---|---|---|
| Cathode Current Density ($A/dm^2$) | 2.0 | 2.0 | 0.3 | 0.3 |
| Plating Temperature (°C.) | 20 | 20 | 20 | 20 |
| Plating Time (min) | 6 | 6 | 40 | 40 |

TABLE 6

Properties of Plating Film (Comparative Examples)

| Properties | 1 | 2 | 3 | 4 |
|---|---|---|---|---|
| Appearance of Plating Film*3 | X | X | Δ | Δ |
| Thickness of Plating Film (μ) | 5.5 | 5.5 | 5.5 | 5.5 |
| Bi Content (%) | 0 | 0 | 35 | 35 |
| Pb Content (%) | 10.0 | 40.0 | 0 | 0 |
| Melting Point (°C.) | 220 | 185 | 180 | 180 |

TABLE 6-continued

Properties of Plating Film (Comparative Examples)

| Properties | 1 | 2 | 3 | 4 |
|---|---|---|---|---|
| Soldering Properties | 1.2 | 0.9 | 0.9 | 0.9 |
| Whisker Formation | None*4 | None | None | None |

*3Δ . . . semi-gloss; X . . . lusterless.
*4Wen-like projections were observed.

When comparing the results listed in Table 3 with those listed in Table 6, it is found that there are not significant differences in the soldering properties and the whisker formation between the plating bath of the present invention and the conventional strongly acidic plating bath.

EXAMPLES 9 to 16 AND COMPARATIVE EXAMPLES 5 to 8

The same procedures used in Examples 1 to 8 or Comparative Examples 1 to 4 were repeated except that a composite part of copper and lead glass was substituted for the copper plate to give each corresponding plating film and the erosive action of each plating bath on the lead glass was estimated. The erosive action was estimated by observing the film with a stereomicroscope. The results thus obtained are summarized in the following Table 7.

TABLE 7

| | Example No. 9 | 10 | 11 | 12 | 13 | 14 | 15 | 16 | Comp. Ex. No. 5 | 6 | 7 | 8 |
|---|---|---|---|---|---|---|---|---|---|---|---|---|
| Plating Bath*5 | 1 | 2 | 3 | 4 | 5 | 6 | 7 | 8 | 1 | 2 | 3 | 4 |
| Erosion | ○ | ○ | ○ | ○ | ○ | ○ | ○ | ○ | X | X | X | X |

○ : not observed; X: observed
*5Each plating bath is denoted by the number of the foregoing Example (Comparative Example).

The results listed in Table 7 clearly indicate that the plating baths of Comparative Examples whose pH values are less than 1 exert erosive action on the lead glass, while the plating bath of the present invention having a higher pH value does not have any erosive action thereon. Accordingly, it is clear that the plating bath of the present invention can effectively prevent any erosion of an insulating material as a constituent of a composite subject to be plated.

EXAMPLES 17 to 24 AND COMPARATIVE EXAMPLES 9 to 12

The same procedures used in Examples 1 to 8 or Comparative Examples 1 to 4 were repeated except that a composite part of nickel and ferrite was substituted for the copper plate to give each corresponding plating film and the erosive action of each plating bath on the ferrite was estimated. The results obtained are summarized in the following Table 8.

TABLE 8

| | Example No. | | | | | | | | Comp. Ex. No. | | | |
|---|---|---|---|---|---|---|---|---|---|---|---|---|
| | 17 | 18 | 19 | 20 | 21 | 22 | 23 | 24 | 9 | 10 | 11 | 12 |
| Plating Bath*5 | 1 | 2 | 3 | 4 | 5 | 6 | 7 | 8 | 1 | 2 | 3 | 4 |
| Erosion | ○ | ○ | ○ | ○ | ○ | ○ | ○ | ○ | X | X | X | X |

○ : not observed; X: observed

*5Each plating bath is denoted by the number of the foregoing Example (Comparative Example).

The results listed in Table 8 clearly indicate that the plating baths of Comparative Examples whose pH values are less than 1 or 0.5 exert erosive action on the ferrite, while the plating bath of the present invention having a higher pH value does not have any erosive action thereon. Accordingly, it is clear that the plating bath of the present invention can effectively prevent any erosion of an insulating material as a constituent of a composite subject to be plated.

What is claimed is:

1. A Sn—Bi alloy plating bath comprising Sn ions, Bi ions and at least one compound selected from the group consisting of a polyoxy monocarboxylic acid, a polyoxy lactone, an aminopolycarboxylic acid and a salt thereof, wherein the bath has a pH value ranging from 2 to 9, the polyoxy monocarboxylic acid has 2 to 6 hydroxyl groups and 3 to 7 carbon atoms, and the polyoxy lactone has 2 to 5 hydroxyl groups and 3 to 7 carbon atoms.

2. The plating bath of claim 1 wherein the bath has a pH value ranging from 4 to 8.

3. The plating bath of claim 1 wherein it comprises the polyoxy monocarboxylic acid, polyoxy lactone, aminopolycarboxylic acid and salt thereof in a concentration ranging from 0.2 to 2.0 mole/l.

4. The plating bath of claim 3 wherein the concentration ranges from 0.25 to 1.0 mole/l.

5. The plating bath of claim 1 wherein the Sn ions are divalent tin ions and a concentration of the divalent tin ions ranges from 1 to 50 g/l.

6. The plating bath of claim 1 wherein the Bi ions are trivalent bismuth ions and a concentration of the trivalent bismuth ions ranges from 0.2 to 40 g/l.

7. The plating bath of claim 1 wherein it further comprises at least one salt selected from the group consisting of alkali metal salts, alkaline earth metal salts, ammonium salts and organic amine salts in an amount of 10 to 200 g/l.

8. The plating bath of claim 1 wherein it further comprises a water-soluble brightening agent in an amount of 0.1 to 20 gl.

9. The plating bath of claim 1 wherein it comprises water.

10. The plating bath of claim 1, wherein the aminopolycarboxylic acid has 2 to 5 carboxyl groups and 1 to 4 amino groups.

11. The bath of claim 1, further comprising one member selected from the group consisting of alkali metal salts, alkaline earth metal salts, ammonium salts, organic amine salts of sulfuric acid, hydrochloric acid, sulfamic acid, pyrophosphoric acid and sulfonic acid.

12. The bath of claim 1, wherein said bath comprises 0 g/l of citric acid and salts thereof.

13. The bath of claim 1, wherein said at least one compound is selected from the group consisting of a polyoxy monocarboxylic acid, a polyoxy lactone and a salt thereof.

14. An electroplating method which comprises applying a Sn—Bi alloy plating film to a substrate in a Sn—Bi alloy plating bath comprising Sn ions, Bi ions and at least one compound selected from the group consisting of a polyoxy monocarboxylic acid, a polyoxy lactone, an aminopolycarboxylic acid and a salt thereof, wherein the bath has a pH value ranging from 2 to 9, the polyoxy monocarboxylic acid has 2 to 6 hydroxyl groups and 3 to 7 carbon atoms, and the polyoxy lactone has 2 to 5 hydroxyl groups and 3 to 7 carbon atoms.

15. The method of claim 14 wherein the substrate to be plated is a composite substance of a metal and an insulating material.

16. The method of claim 15 wherein the insulating material is at least one member selected from the group consisting of ceramics, lead glass, plastics and ferrite.

17. The method of claim 14, wherein the aminopolycarboxylic acid has 2 to 5 carboxyl groups and 1 to 4 amino groups.

18. The method of claim 14, wherein said plating bath further comprises one member selected from the group consisting of alkali metal salts, alkaline earth metal salts, ammonium slats, organic amine slats of sulfuric acid, hydrochloric acid, sulfamic acid, pyrophosphoric acid and sulfonic acid.

19. The method of claim 14, wherein said plating bath comprises 0 g/l of citric acid and salts thereof.

20. The method of claim 14, wherein said at least one compound is selected from the group consisting of a polyoxy monocarboxylic acid, a polyoxy lactone and a slat thereof.

21. A method for forming a Sn—Bi alloy plating onto a substrate which comprises the steps of immersing the substrate into a Sn—Bi alloy plating bath comprising Sn ions, Bi ions, at least one compound selected from the group consisting of a polyoxy monocarboxylic acid, a polyoxy lactone, an aminopolycarboxylic acid and a salt thereof and water, the bath having a pH of 2 to 9, and applying a current density of 0.1 to 5 A/dm$^2$ to the substrate as a cathode at a temperature of 10 to 40° C. for 1 to 120 minutes using an anode to form a Sn—Bi alloy film of bismuth content of 0.1 to 75% and a balance of tin onto the substrate, wherein the polyoxy monocarboxylic acid has 2 to 6 hydroxyl groups and 3 to 7 carbon atoms and the polyoxy lactone has 2 to 5 hydroxyl groups 3 to 7 carbon atoms.

22. The method of claim 21, wherein said at least one compound is selected from the group consisting of a polyoxy monocarboxylic acid, a polyoxy lactone and a slat thereof.

* * * * *